US010774600B2

(12) United States Patent
Zouhair

(10) Patent No.: US 10,774,600 B2
(45) Date of Patent: Sep. 15, 2020

(54) SLIP MONITOR AND CONTROL

(71) Applicant: Weatherford Technology Holdings, LLC, Houston, TX (US)

(72) Inventor: Aicam Zouhair, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 42 days.

(21) Appl. No.: 15/242,313

(22) Filed: Aug. 19, 2016

(65) Prior Publication Data

US 2018/0051526 A1 Feb. 22, 2018

(51) Int. Cl.

| | |
|---|---|
| ***E21B 19/10*** | (2006.01) |
| ***E21B 19/07*** | (2006.01) |
| ***E21B 33/04*** | (2006.01) |

(52) U.S. Cl.

CPC ..... *E21B 19/10* (2013.01); *E21B 19/07* (2013.01); *E21B 33/0422* (2013.01)

(58) Field of Classification Search

CPC ..... E21B 19/07; E21B 19/10; E21B 33/0422; F16B 2/14

See application file for complete search history.

(56) References Cited

U.S. PATENT DOCUMENTS

| | | | | |
|---|---|---|---|---|
| 1,541,669 | A | 6/1925 | Summers | |
| 2,063,361 | A | 12/1936 | Baash | |
| 2,298,507 | A | 10/1942 | Penick et al. | |
| 2,491,711 | A * | 12/1949 | Calhoun | E21B 19/10 173/166 |
| 2,589,159 | A | 3/1952 | Stone | |
| 2,934,148 | A | 4/1960 | Allaire | |
| 3,188,708 | A | 6/1965 | O'Haver | |
| 3,287,776 | A | 11/1966 | Brown | |
| 3,330,354 | A | 7/1967 | Chamblee | |

(Continued)

FOREIGN PATENT DOCUMENTS

| | | | |
|---|---|---|---|
| CA | 2284428 | A1 | 4/2001 |
| DE | 19814033 | A1 | 10/1999 |

(Continued)

OTHER PUBLICATIONS

PCT International Search Report and Written Opinion dated Oct. 16, 2017, for International Application No. PCT/US2017/044811.

(Continued)

*Primary Examiner* — Christopher J Sebesta

(74) *Attorney, Agent, or Firm* — Patterson + Sheridan, LLP

(57) ABSTRACT

An apparatus for slip monitor and control includes a body; a plurality of slips; a transmitter for each slip; at least one receiver coupled to the body; and an actuator for each slip configured to move the respective slip vertically relative to the body. A method for slip monitor and control includes obtaining slip positional information for a plurality of slips; determining whether the slip positional information for each of the slips matches criteria; and sending one or more control signals to one or more actuators, each actuator configured to move one of the slips vertically relative to a body. A method for handling a tubular includes actuating a plurality of slips to move vertically relative to a body; engaging the tubular with at least one of the slips; measuring positional data of the plurality of slips; and identifying an offset pipe condition.

22 Claims, 10 Drawing Sheets

(56) References Cited

U.S. PATENT DOCUMENTS

| | | | | |
|---|---|---|---|---|
| 3,675,278 | A | 7/1972 | Powell | |
| 3,748,702 | A | 7/1973 | Brown | |
| 4,354,706 | A | 10/1982 | Coyle, Sr. | |
| 4,381,584 | A | 5/1983 | Coyle, Sr. | |
| 4,523,645 | A | 6/1985 | Moore | |
| 4,600,054 | A | 7/1986 | Miller et al. | |
| 4,621,974 | A | 11/1986 | Krueger | |
| 4,643,259 | A | 2/1987 | Zeringue, Jr. | |
| 4,715,456 | A | 12/1987 | Poe, Jr. et al. | |
| 4,867,236 | A | 9/1989 | Haney et al. | |
| 5,335,756 | A | 8/1994 | Penisson | |
| 5,484,040 | A | 1/1996 | Penisson | |
| 5,609,226 | A | 3/1997 | Penisson | |
| 5,848,647 | A | 12/1998 | Webre et al. | |
| 6,089,338 | A | 7/2000 | Bouligny, Jr. | |
| 6,192,981 | B1 | 2/2001 | Boquet et al. | |
| 6,227,587 | B1 | 5/2001 | Terral | |
| 6,378,399 | B1 | 4/2002 | Bangert | |
| 6,892,835 | B2 | 5/2005 | Shahin et al. | |
| 7,370,707 | B2 | 5/2008 | McDaniel et al. | |
| 7,686,088 | B2 | 3/2010 | Shahin | |
| 8,322,687 | B2 | 12/2012 | Faccio et al. | |
| 8,939,219 | B2 | 1/2015 | Taskinen et al. | |
| 2003/0066718 | A1 | 4/2003 | Buck | |
| 2003/0173117 | A1 | 9/2003 | Mason et al. | |
| 2004/0016575 | A1 | 1/2004 | Shahin et al. | |
| 2004/0188098 | A1* | 9/2004 | Schulze-Beckinghausen | E21B 19/07 166/380 |
| 2007/0235229 | A1* | 10/2007 | Henderson | E21B 19/10 175/423 |
| 2007/0261893 | A1* | 11/2007 | Campisi | E21B 19/10 175/423 |
| 2010/0025046 | A1* | 2/2010 | Francis | B23P 19/069 166/380 |
| 2010/0193198 | A1 | 8/2010 | Murray et al. | |
| 2010/0270033 | A1* | 10/2010 | Angelle | E21B 19/07 166/380 |
| 2013/0153213 | A1* | 6/2013 | Angelle | E21B 19/24 166/250.01 |
| 2015/0021946 | A1* | 1/2015 | Vierke | E21B 19/07 294/86.24 |
| 2015/0107857 | A1 | 4/2015 | Mosing et al. | |
| 2015/0144325 | A1 | 5/2015 | Heidecke et al. | |
| 2015/0315855 | A1 | 11/2015 | Dewald et al. | |
| 2016/0290073 | A1* | 10/2016 | Zheng | E21B 19/10 |
| 2016/0356104 | A1* | 12/2016 | Vierke | E21B 19/07 |

FOREIGN PATENT DOCUMENTS

| | | | |
|---|---|---|---|
| EP | 047441 | A1 | 3/1982 |
| FR | 2658972 | A1 | 8/1991 |
| GB | 2014215 | A | 8/1979 |
| GB | 2355030 | A | 4/2001 |
| WO | 9958810 | A2 | 11/1999 |
| WO | 0169034 | A2 | 9/2001 |
| WO | 236927 | A1 | 5/2002 |

OTHER PUBLICATIONS

PCT International Search Report, International Application No. PCT/US 03/22761, dated Dec. 2, 2003.

EPO Office Action dated Jan. 29, 2020, for European Patent Application No. 17749586.8.

* cited by examiner

SLIP MONITOR AND CONTROL

BACKGROUND OF THE INVENTION

Field of the Invention

Embodiments of the present invention generally relate to tubular handling tools, and more specifically to methods and apparatuses for monitor and control of slip movement for tubular handling tools.

The handling of tubular strings has traditionally been performed with the aid of a spider and/or an elevator. Typically, spiders and elevators include a plurality of slips that are disposed about the inner circumference of a housing, also known as a bowl. The slips include teeth that grip the tubular string. The inner surface of the housing is inclined so that the slips may be moved downwardly and radially inward into engagement with the tubular string, and may be moved upwardly and radially outward out of engagement with the tubular string.

To ensure that the tubular string is properly supported, it is important that the slips engage the tubular string uniformly about its circumference. The slips are generally positioned symmetrically around the tubular string. However, as the slips are moved into engagement with the tubular string, one slip may contact the tubular before another slip, and thereby move the tubular string into a slightly off-center position. Non-uniform engagement may also result in crushing, tilting, or twisting of the tubular string. Conventional tubular handling tools have relied on the leveling ring to facilitate synchronous movement of the slips. These solutions have proven to be limited under the extreme operating conditions typically experienced by tubular handling tools.

There is a need, therefore, for a method and apparatus of monitoring and controlling the slip movement of a tubular handling tool.

SUMMARY OF THE INVENTION

Embodiments of the present invention generally relate to tubular handling tools, and more specifically relates to methods and apparatuses for monitor and control of slip movement for tubular handling tools.

In an embodiment, a slip monitor and control system includes a body; a plurality of slips; a transmitter for each slip; at least one receiver coupled to the body; and an actuator for each slip configured to move the respective slip vertically relative to the body.

In an embodiment, a method of slip monitor and control includes obtaining slip positional information for a plurality of slips; determining whether the slip positional information for each of the slips matches criteria; and sending one or more control signals to one or more actuators, each actuator configured to move one of the slips vertically relative to a body.

In an embodiment, a method of handling a tubular includes actuating a plurality of slips to move vertically relative to a body; engaging the tubular with at least one of the slips; measuring positional data of the plurality of slips; and identifying an offset pipe condition.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to tubular handling tools, and more specifically to methods and apparatuses for monitor and control of slip movement for tubular handling tools.

Figure 1:
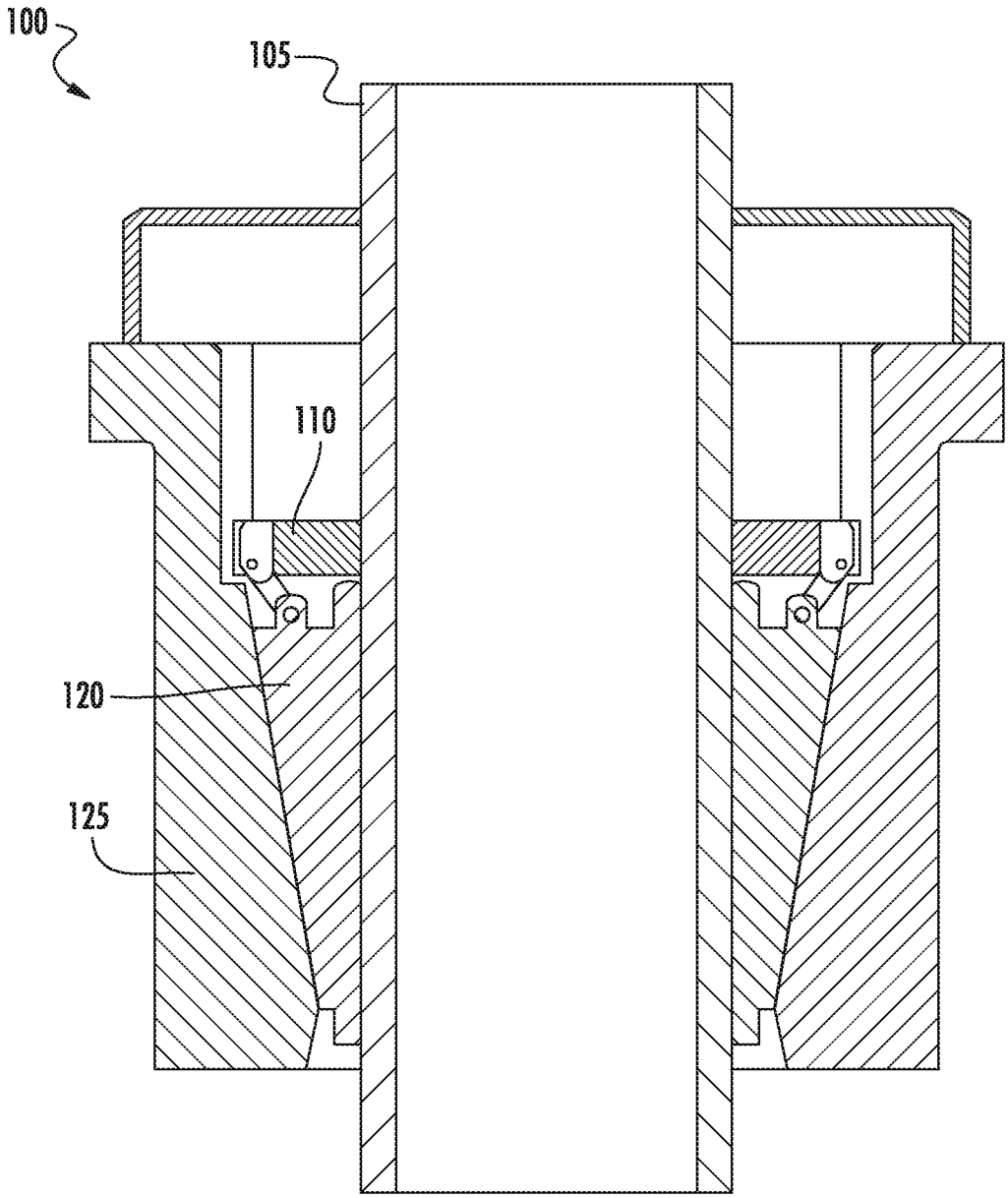
FIG. 1 is a simplified sectional view of a tubular handling tool engaged with a tubular.

FIG. 1 is a simplified sectional view of a tubular handling tool, including spider 100, engaged with a tubular 105. The spider 100 includes a body 125, for housing one or more gripping members, such as slips 120. The body 125 of the spider 100 may be formed by pivotally coupling two sections using one or more connectors. The slips 120 are configured to move vertically relative to the body 125. As used herein, "move vertically" means primarily in a direction that follows or opposes gravity, though operational conditions may dictate some consequential horizontal motion (for example, when a tubular is in a tilted position). The slips 120 of spider 100 are shown engaging the tubular 105 which may be part of a string of tubulars. The spider 100 may include a leveling ring 110 for coupling the slips together and/or assisting to synchronize their vertical movement.

Figure 2A:
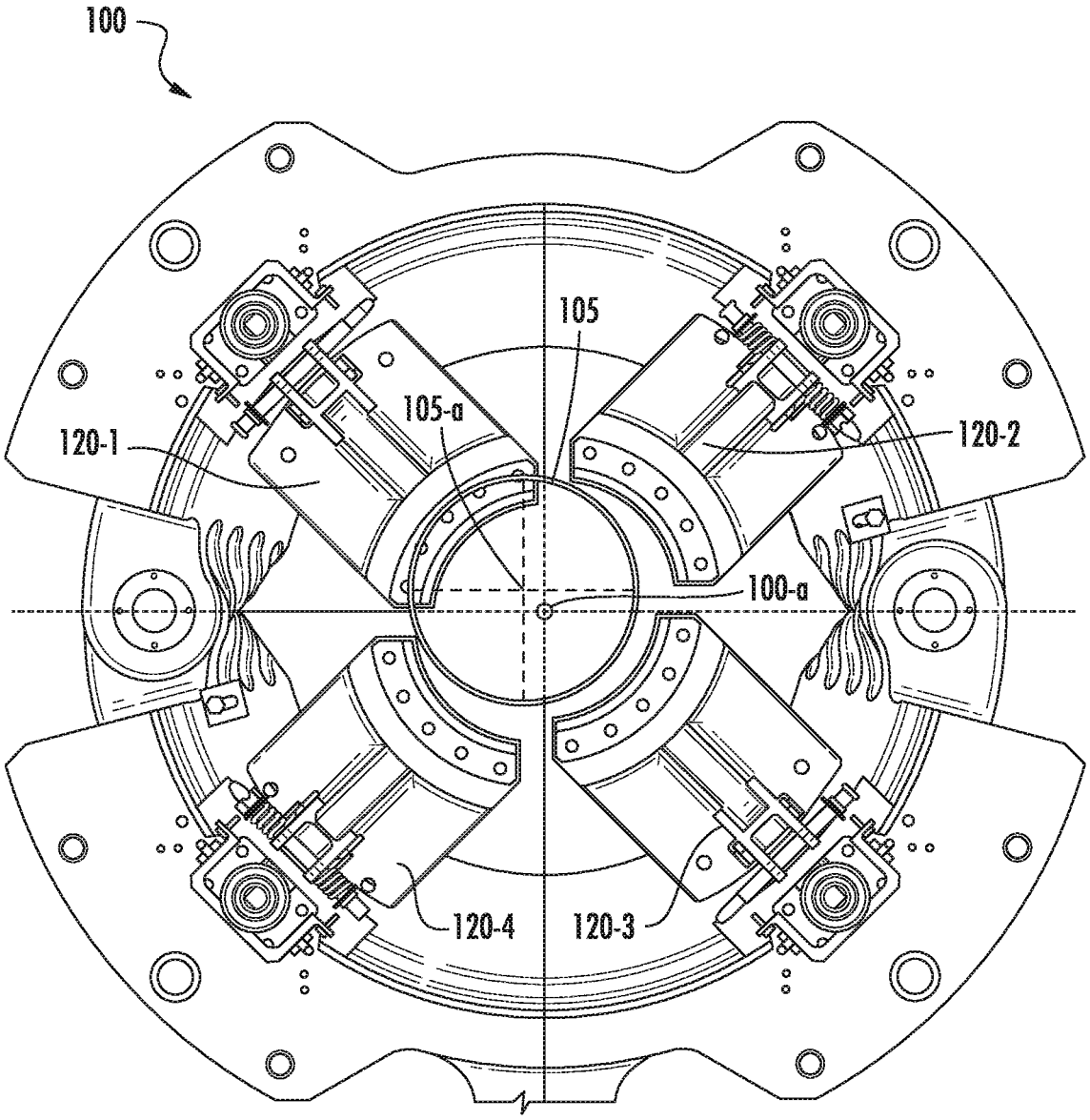
FIGS. 2A and 2B illustrate potential offset pipe conditions.

FIG. 2A illustrates a potential configuration of tubular 105 in an off-center position as seen from above spider 100. In this illustration, four slips 120 are shown, though some embodiments may utilize three, five, six, or more slips 120, distributed around spider 100. In some embodiments, slips 120 are distributed symmetrically around spider 100. The central axis 105-*a* of tubular 105 can be seen to be out of alignment with the central axis 100-*a* of spider 100. Slip 120-1 is shown as fully engaged with tubular 105; slips 120-2 and 120-4 are partially engaged, and slip 120-3 is not at all engaged with tubular 105.

Figure 2B:
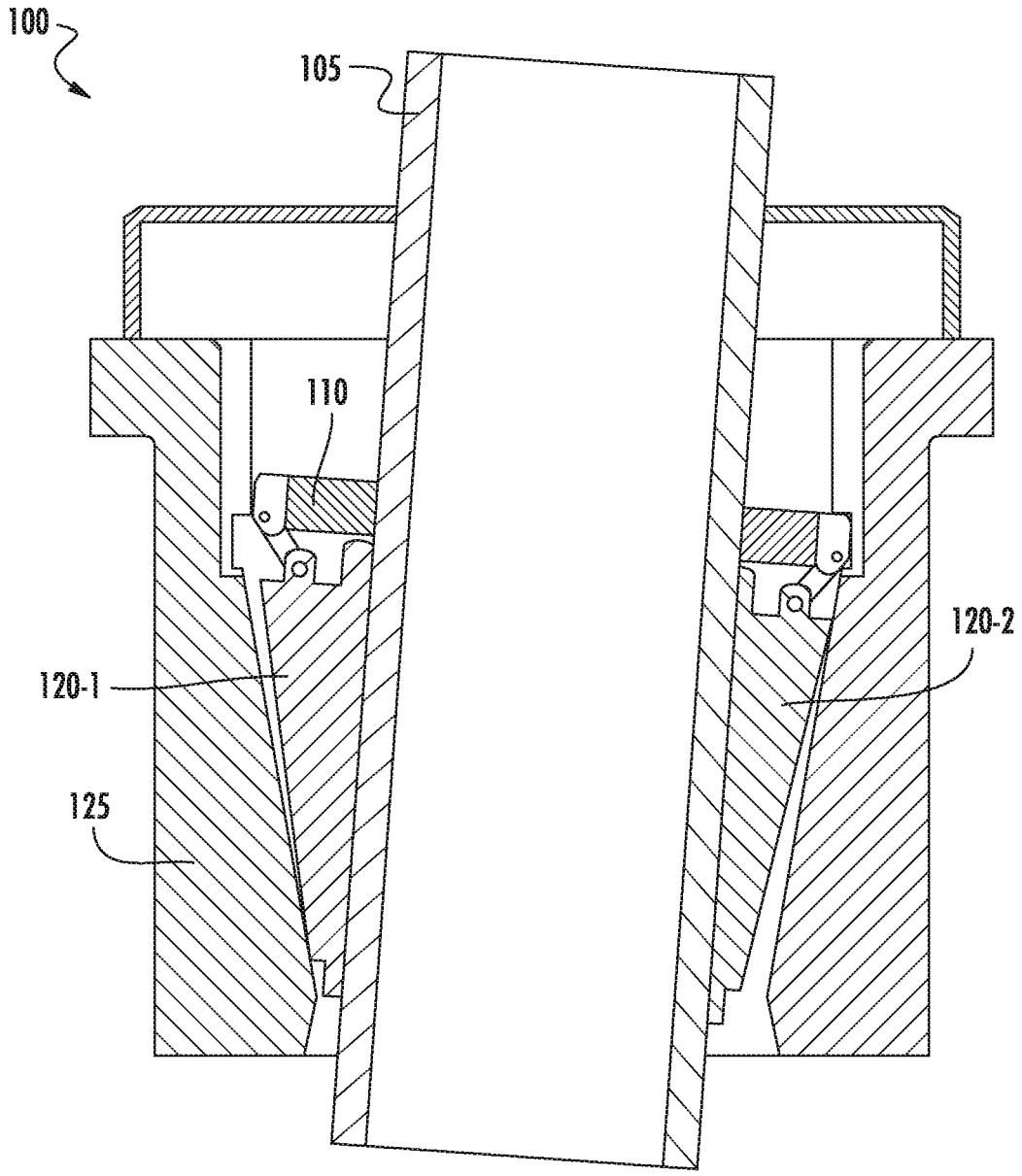

FIG. 2B illustrates a potential configuration of tubular 105 in a tilted position as seen in a sectional view of spider 100. Slip 120-1 can be seen to engage tubular 105 higher, being higher in the body 125, than slip 120-2.

In addition to off-center position (FIG. 2A) and tilted position (FIG. 2B), other potential configurations of tubular 105 and spider 100 exist that represent offset pipe conditions that may benefit from slip monitor and control.

During typical operations, slips 120 and leveling ring 110 operate within a closed environment. Visual access to the positioning of tubular 105 may be limited or completely unavailable. Therefore, embodiments provide systems and methods that may both monitor and control slip position and movement.

Figure 3:
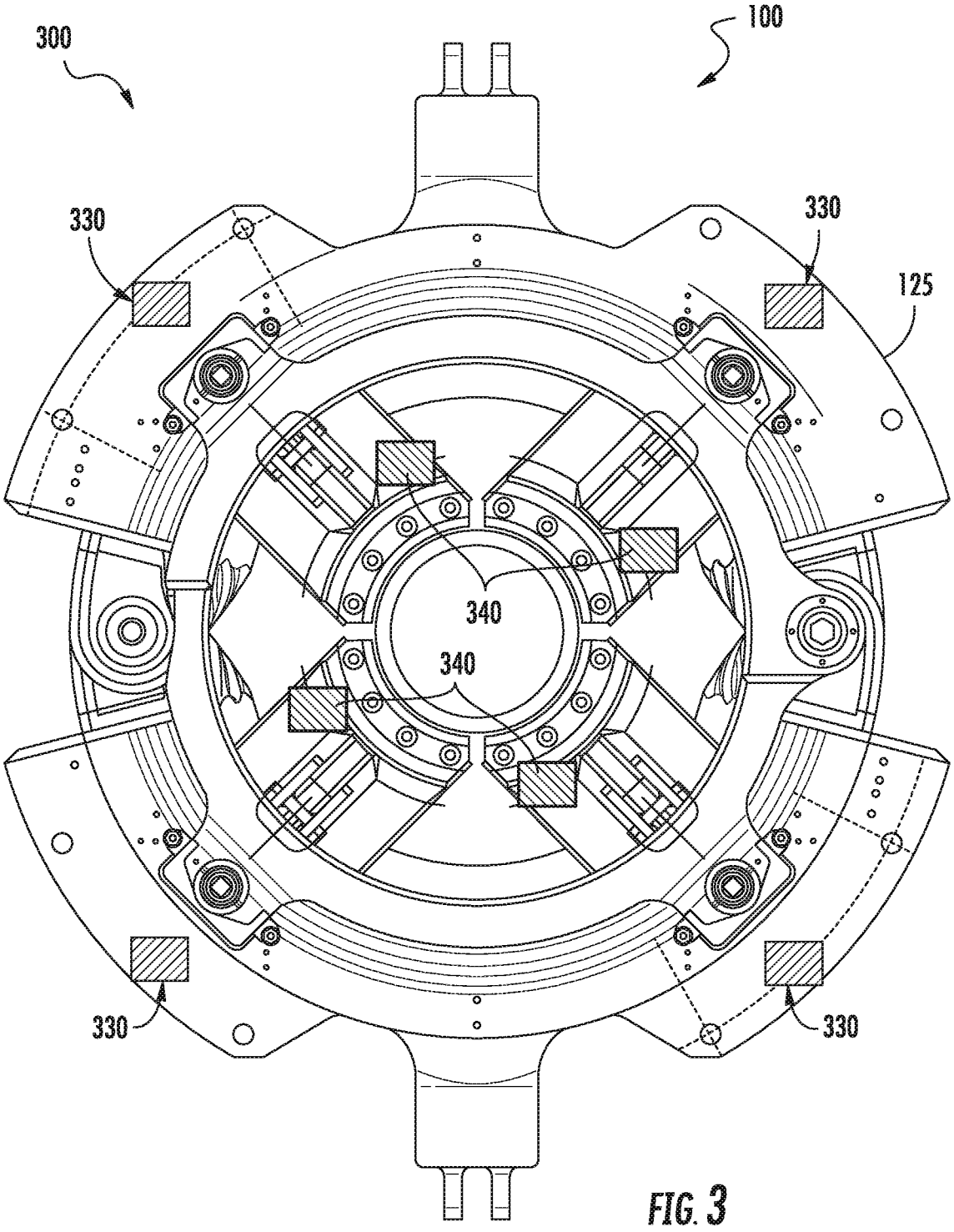
FIG. 3 illustrates a slip monitor and control system.

FIG. 3 illustrates an embodiment of a slip monitor and control system 300 for a tubular handling tool. As illustrated, the system 300 has four receivers 330 mounted in a fixed position relative to the spider 100, for example, on body 125. The number and location of receivers 330 may vary, as further described below. As illustrated, system 300 also has four transmitters 340, each mounted on a respective slip 120. The number and location of transmitters 340 may vary, as further described below. In some embodiments, each slip 120 will have a dedicated transmitter 340. In some embodiments, each transmitter 340 will have a dedicated receiver 330.

Figure 4B:
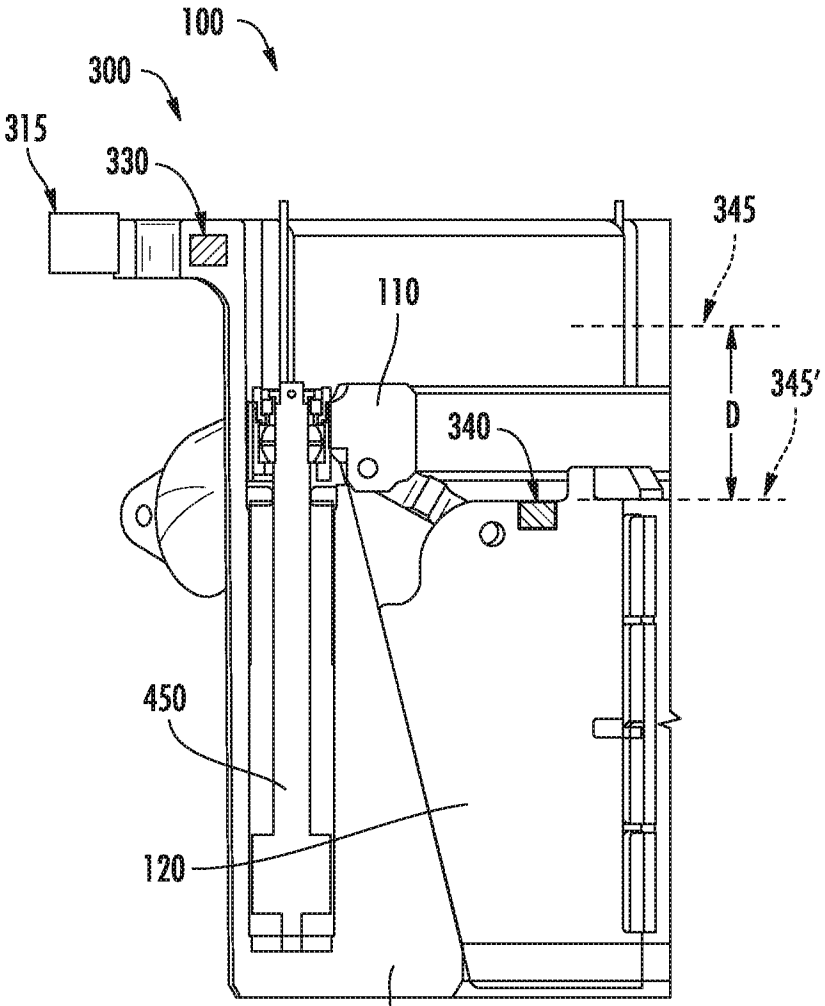
FIGS. 4A and 4B illustrate movement of a slip.
Figure 4A:
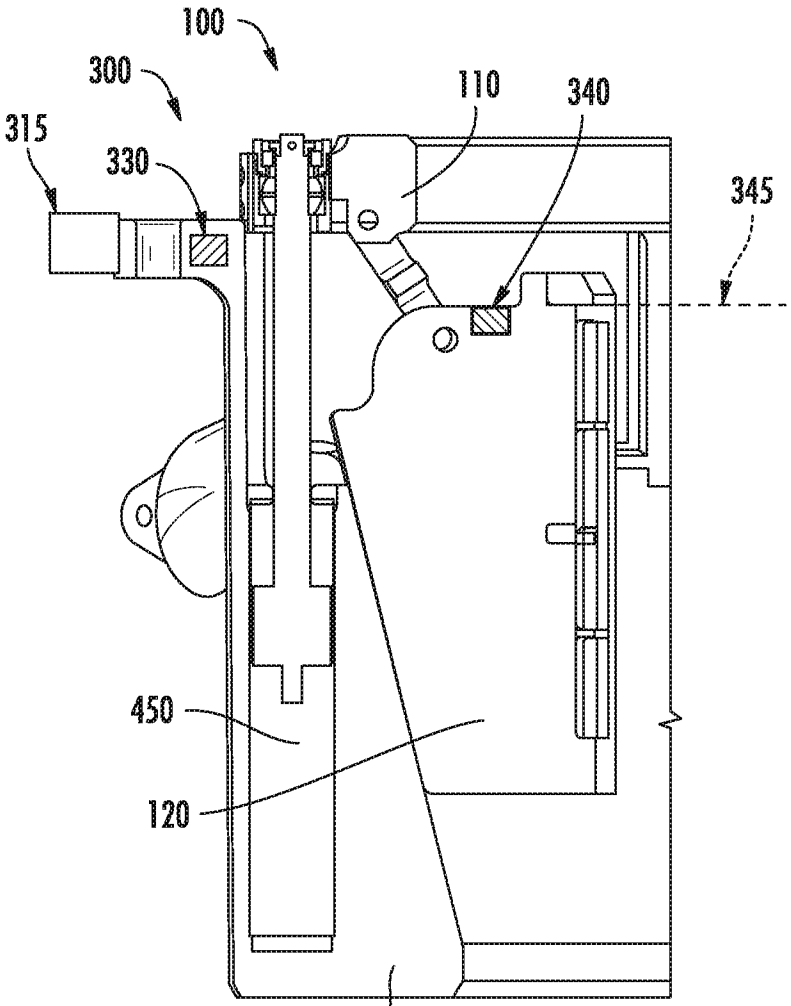

FIGS. 4A and 4B illustrate movement of a slip 120 in an embodiment of a tubular handling tool. Movement of slip 120 within spider 100 may be initiated, halted, and/or controlled by an actuator (or collection of actuators), for example, piston 450. During operation, piston 450 may cause slip 120 to move vertically, for example downward by a distance D from its position 345 in FIG. 4A to its position 345' in FIG. 4B. Transmitter 340 may utilize one or more sensor to sense, measure, or calculate position and/or positional change, and may send that slip positional information to receiver 330. Exemplary sensors may include absolute position sensors, relative position sensors, motion sensors, accelerometers, linear variable differential sensors, rotational variable displacement sensors, magneto-restrictive positions sensors, resistive sensors, among others. Exemplary sensors may include Linear Displacement Transducer Position Sensors available from Parker Hannifin Corp. For example, transmitter 340 may be capable of measuring both position and time, and may calculate speed and/or acceleration. Transmitter 340 may be capable of measuring speed and time, and may calculate position and/or acceleration. Transmitter 340 may be capable of measuring acceleration and time, and may calculate position and/or speed. In some embodiments, transmitter 340 only senses or measures one positional data component (for example, one of position data, speed data, and acceleration data), and sends that component to receiver 330 where time measurements and calculation of other positional data components may occur, resulting in slip positional information at receiver 330. Transmitter 340 may send slip positional information to receiver 330 through one or more communication channels, such as electrical wires, optical fibers, wireless signals (such as radio waves, laser light, etc.), hydraulic lines, and pneumatic lines. In some embodiments, transmitter 340 and/or receiver 330 may be in communication with control module 315 where time measurements and calculation of other positional data components may occur. In some embodiments, transmitters 340 may be adapted for expected operating conditions, having characteristics such as providing high performance data transfer, operate in a temperature range of between about −4° F. to about 158° F., being explosion proof (e.g., ATEX certified), being intrinsically safe, having a compact design, providing accuracies of +/−6%, and a life expectancy of at least 50 million cycles.

Slip monitor and control system 300 may use slip positional information from transmitters 340 and receivers 330 to monitor and control slip movement during operations. In some embodiments, the system 300 may utilize a control module 315 to monitor system 300, for example to identify an offset pipe condition. Control module 315 may determine from the slip positional information that slip 120-1 is higher in body 125 than slip 120-2 (as shown in FIG. 2B). Control module 315 may respond by sending a control signal to piston 450-1, corresponding to slip 120-1, to increase downward speed of slip 120-1. Control module 315 may also respond by sending a control signal to piston 450-2, corresponding to slip 120-2, to decrease downward speed of slip 120-2. Control module 315 may respond by sending opposing control signals to both pistons 450-1 and 450-2. Control module 315 may send control signals to the actuators through one or more communication channels, such as electrical wires, optical fibers, wireless signals (such as radio waves, laser light, etc.), hydraulic lines, and pneumatic lines. As illustrated, control module 315 is located on body 125, but other locations are possible, such as integrated with a receiver 330, on a slip 120 (such as a master slip, as discussed below), on leveling ring 110, or as part of a control panel remote from the spider 100, such as in a control room. In some embodiments, control module 315 may be adapted for expected operating conditions, having characteristics such as being modular, providing high performance data transfer, capable of operating in a temperature range of between about −4° F. to about 158° F., being explosion proof (e.g., ATEX certified), being intrinsically safe, having a compact design, providing accuracies of +/−6%, and a life expectancy of at least 50 million cycles.

In some embodiments, various signal options may be utilized for the slip positional information, the control signals, and/or any other communications between elements of slip monitor and control system 300. The signal options may utilize any of the aforementioned communication channels. The signal options may include, for example, a simple amplitude signal wherein the amplitude of the signal is proportional to the position of the slip. The signal options may include a variety of digital pulses, for example, a first digital pulse may have a duration that is proportional to the desired slip position. As another example, multiple pulses may be used in conjunction, each representing slip movement of a known increment. The signal options may include a digital coding system, for example, with a digital distinctive code for each known slip position, such as Open Slip=code 1, Midway Open Slip=code 2, and Closed Slip=code 3.

In some embodiments, slip monitor and control system 300 may log slip positional information for later review and assessment. For example, in the event that a tubular is mishandled, a log of slip positional information may be reviewed to identify possible fault conditions. Comparison of logs over time for a particular tubular handling tool and/or between or amongst several tubular handling tools may identify expected conditions and/or unexpected conditions. For example, if a particular tubular handling tool logs significantly more adjustments to a particular slip, for example slip 120-3, than to other slips of that tubular handling tool and/or other similarly positioned slips of other tubular handling tools, it may be determined that slip 120-3 is in a potential fault condition. That tubular handling tool may then be taken out of service for remediation of slip 120-3.

In some embodiments, slip monitor and control system 300 may coordinate the position and/or movement of the plurality of slips by way of a master-match system. For example, as illustrated in FIG. 5A, slip 120-1 may be designated as the "master". System 300 may monitor positional information of slips 120-1, 2, 3, 4 by sensors for transmitters 340-1, 2, 3, 4 on the respective slips. Positional information data from the sensors may be sent by transmitter 340-1, 2, 3, 4, related to the respective slips, to one or more receivers 330, for example receiver 330-1. System 300 may send control signals to pistons 450-2, 3, 4, corresponding to slips 120-2, 3, 4, to make the position/and or movement of those slips better match criteria, such as the position/and or movement of slip 120-1, as indicated by slip positional information from receiver 330-1. For example, it may be desired that the positions of the non-master slips 120-2, 3, 4 match the position of master slip 120-1 to within 0.25 inch or less. In some embodiments, it may be desired that the positions of the non-master slips 120-2, 3, 4 match the position of master slip 120-1 to within 0.125 inch or less. It may be desired that the speed of the non-master slips 120-2, 3, 4 match the speed of the master slip 120-1 to within 10 cm/s or less. In some embodiments, it may be desired that the speed of the non-master slips 120-2, 3, 4 match the speed of the master slip 120-1 to within 5 cm/s or less. As used herein, "match" does not require exact equivalence, but rather indicates close correspondence, for example, no more than 10% deviation from exact equivalence.

Figure 5B:
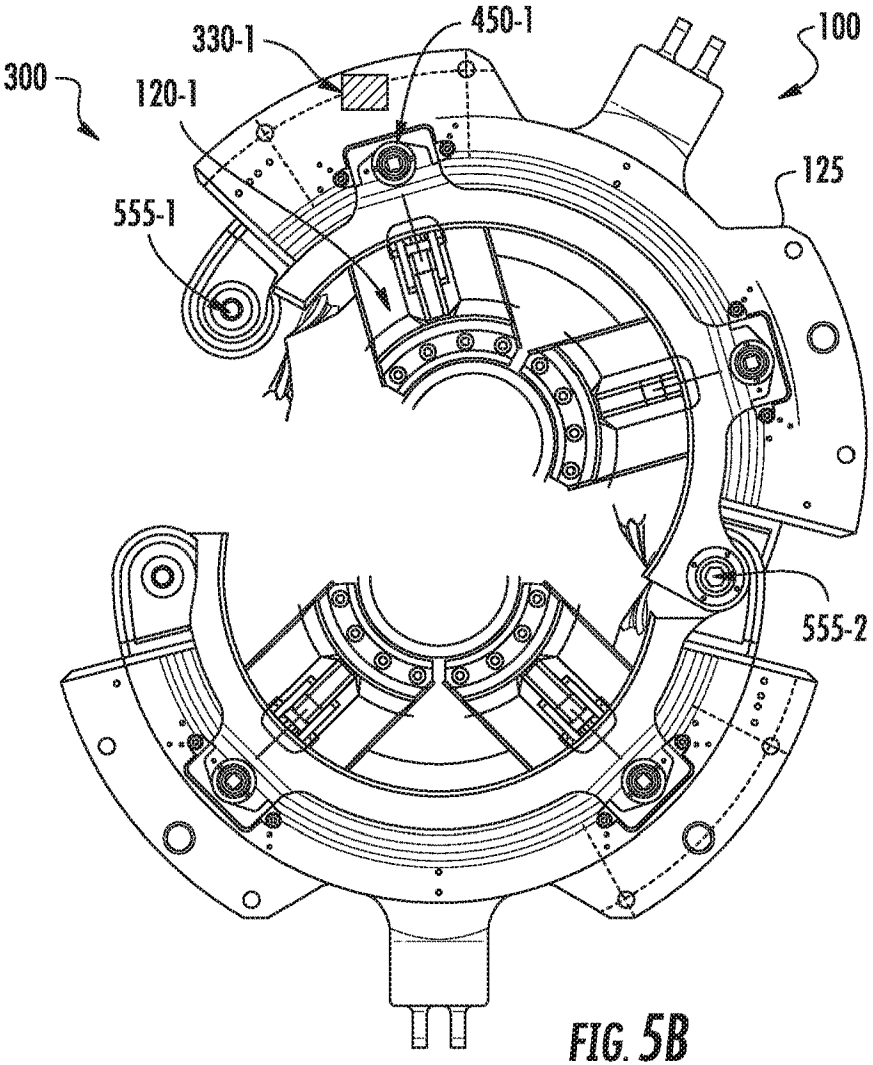
FIGS. 5A, 5B, and 5C illustrate a slip monitor and control system.
Figure 5A:
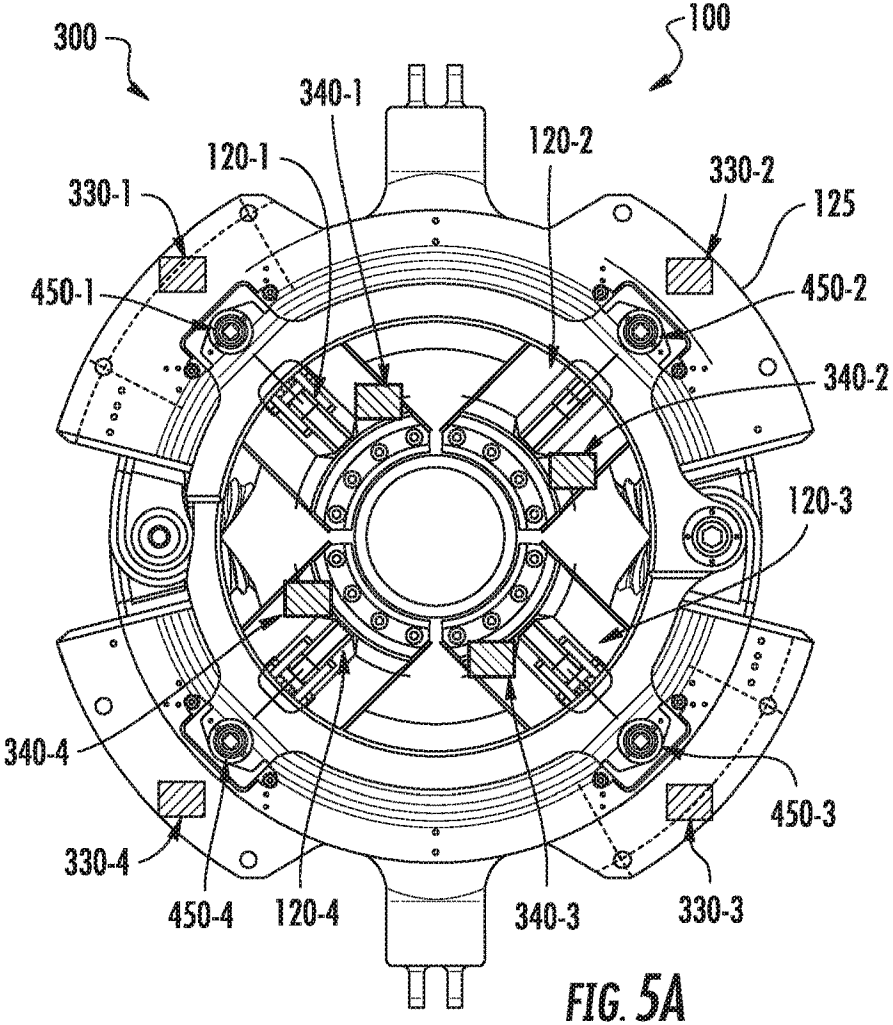
Figure 5C:
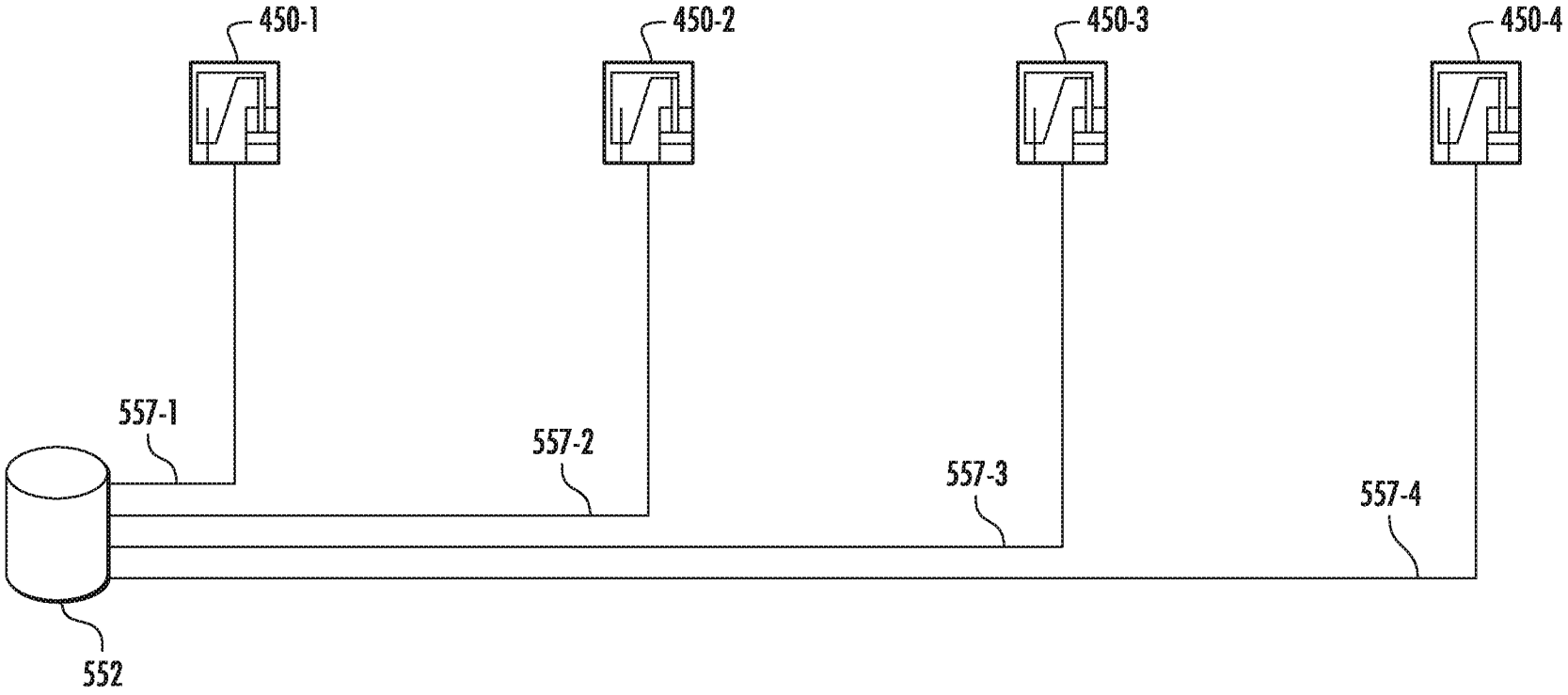

As seen in FIGS. 5B and 5C, in some embodiments, the master slip may be identified as that slip located closest (as measured by length of hydraulic control lines 557) to the hydraulic control reservoir 552. For example, body 125 of the spider 100 may be formed by pivotally coupling two sections using connectors 555-1, 2. In the illustrated embodiment, hydraulic lines run clockwise around body 125, starting at connector 555-1, coupling first with piston 450-1, then with pistons 450-2, 3, 4 in succession. As would be understood by one of ordinary skill in the art with the benefit of this disclosure, there may be a small, but non-zero, time lag between actuation of each piston 450 that varies with distance from the hydraulic control reservoir. It may be, therefore, beneficial to identify the slip located most closely to the hydraulic control reservoir as the master slip, since the expected time lag for the corresponding piston 450-1 would be less than for any other piston 450-2, 3, 4.

In some embodiments, each piston 450 may be equipped with a proportional control valve to adjust hydraulic flow, thereby slip speed, in order to maintain coordination of the slips with a higher level of accuracy. In some embodiments, check valves may be utilized to put each piston 450 in a fail-safe condition to prevent accidental opening of the slip 120 in the event hydraulic pressure is lost. In some embodiments, pressure control valves may be utilized with each piston 450, in addition to or in lieu of sensors, to obtain slip positional information based on assumptions about piston pressure and slip position.

Figure 6A:
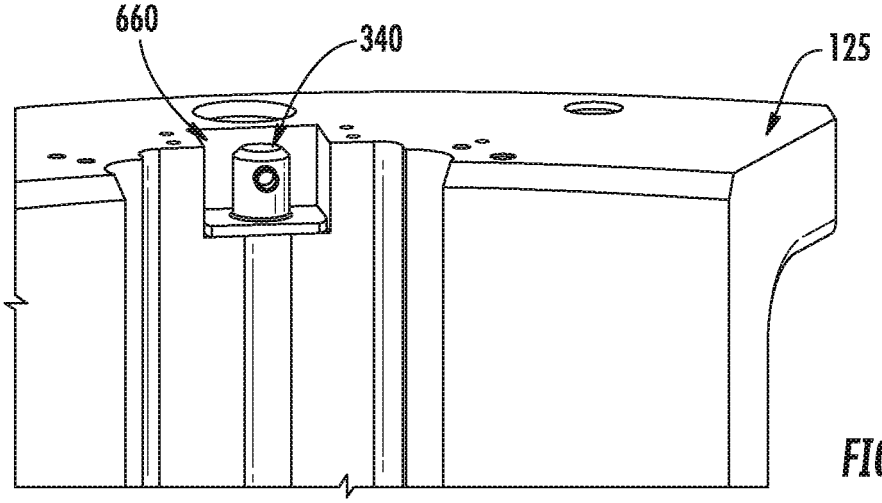
FIGS. 6A and 6B illustrate examples of a coupling of a receiver to a tubular handling tool body.
Figure 6B:
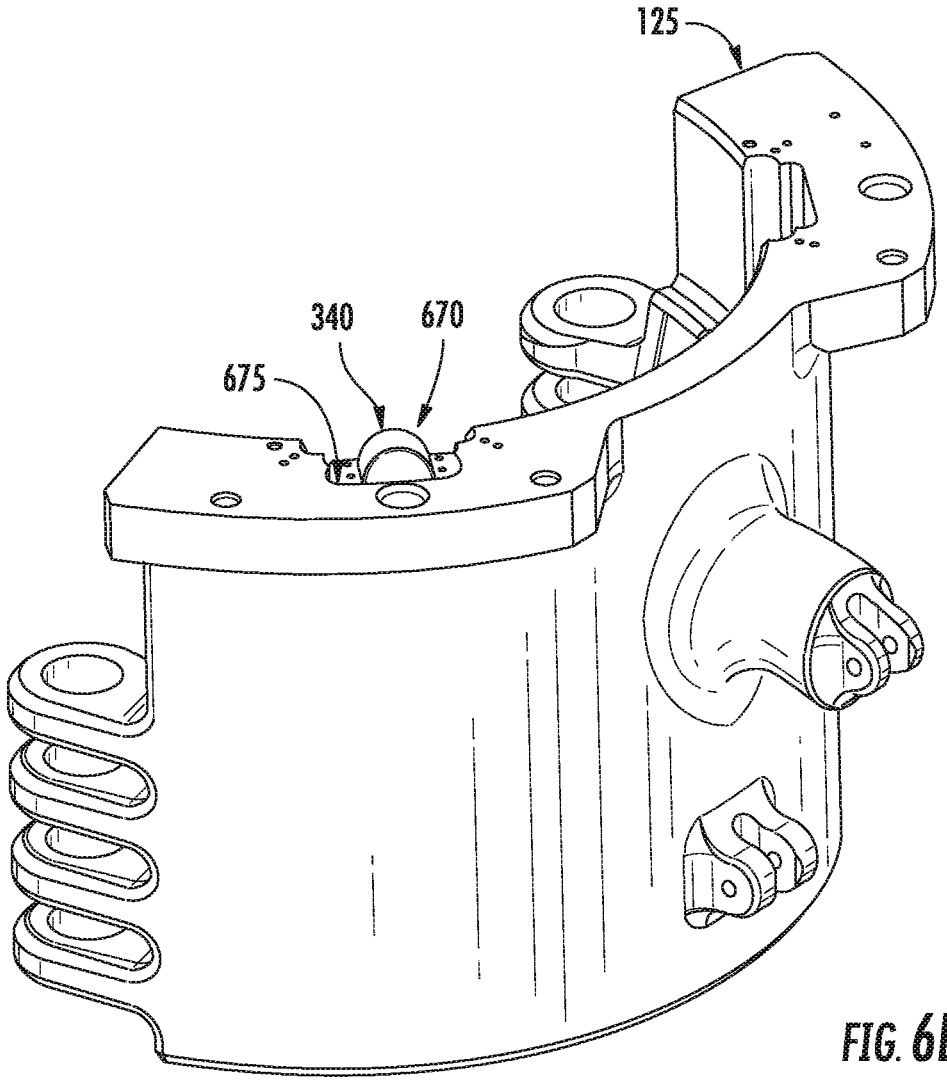

In some embodiments, receivers 340 may be coupled to a tubular handling tool body, such as body 125, in a recess, groove, or pocket. For example, FIG. 6A illustrates receiver 340 in a machined pocket 660 of body 125. In some embodiments, receivers 340 may be coupled to body 125 with an external mounting. This option may be preferable when retrofitting existing systems. For example, FIG. 6B illustrates receiver 340 in a mounted housing 670 attached with mounting holes 675 to body 125.

Figure 7A:
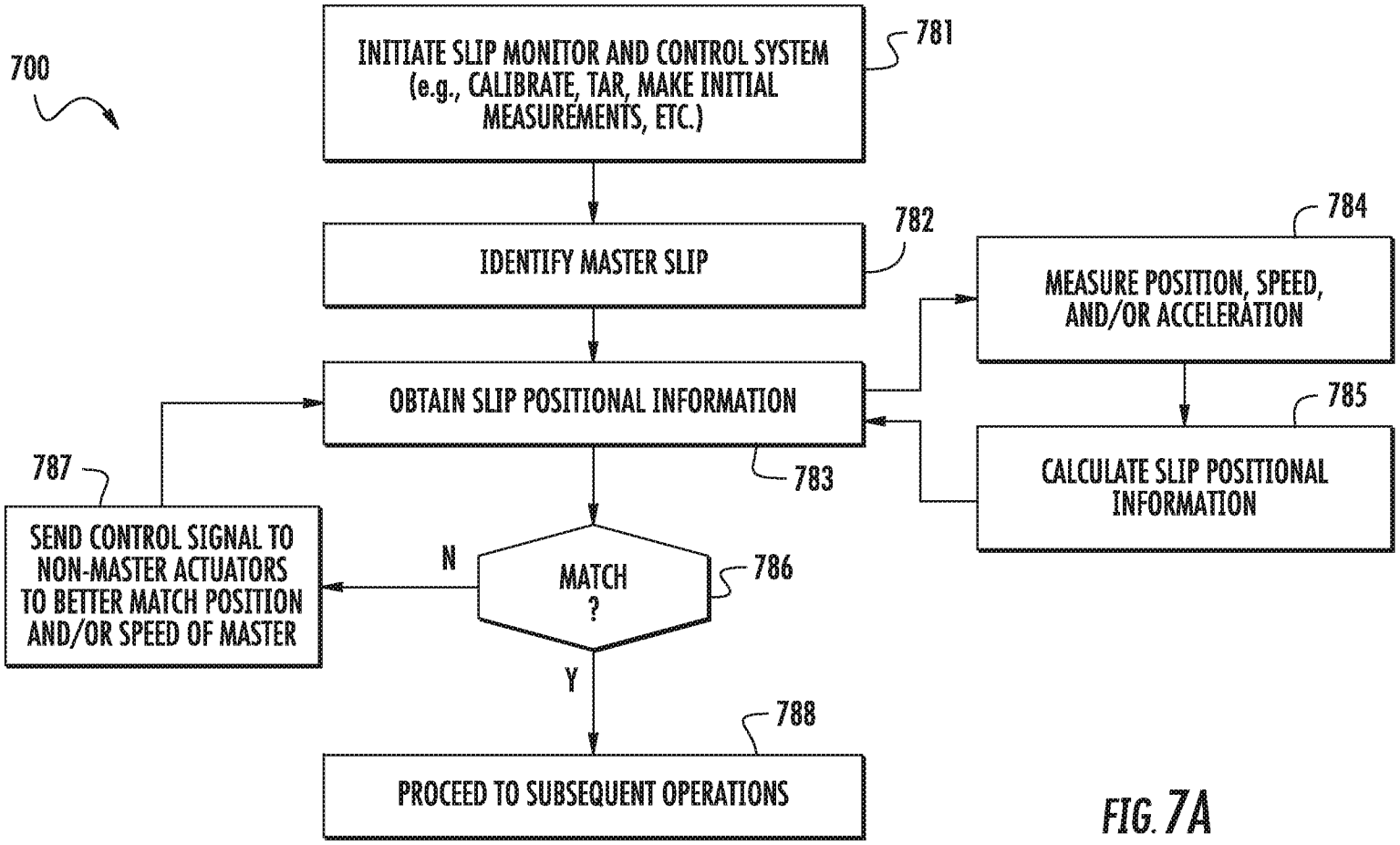
FIGS. 7A and 7B illustrate methods of slip monitor and control.

A method 700 of slip monitor and control is illustrated in FIG. 7A. At step 781, the slip monitor and control system 300 is initiated. This may include one or more steps such as calibrating the system, tarring the weight of the tubular 105, making initial positional data component measurements of the slips 120, or other initialization steps. If a master-match system will be used to coordinate the position and/or movement of the plurality of slips, the master slip is identified at step 782. Slip positional information is obtained at step 783. Slip positional information, such as data about slip position, speed, and/or acceleration, may be obtained by sensors on slips 120 at step 784. Transmitters 340 may calculate additional slip positional information, or transmitters 340 may send the measured data to receivers 330 which may then calculate additional slip positional information at step 785. If a master-match system is used, at step 786 the slip positional information may then be analyzed to determine whether the slip positional information of the non-master slips (for example, slips 120-2, 3, 4) matches that of the master slip (for example, slip 120-1). In other words, determine whether the slip positional information of the non-master slips matches the criteria of the slip positional information of the master slip. If the slip positional information does not match, the slip monitor and control system 300 may send control signals to the actuators of the non-master slips 120-2, 3, 4 to better match the position and/or speed of the master slip 120-1 at step 787. Once the slip positional information of the non-master slips 120-2, 3, 4 matches that of the master slip 120-1, the slip monitor and control system passes control to other systems at step 788 for subsequent operations.

Figure 7B:
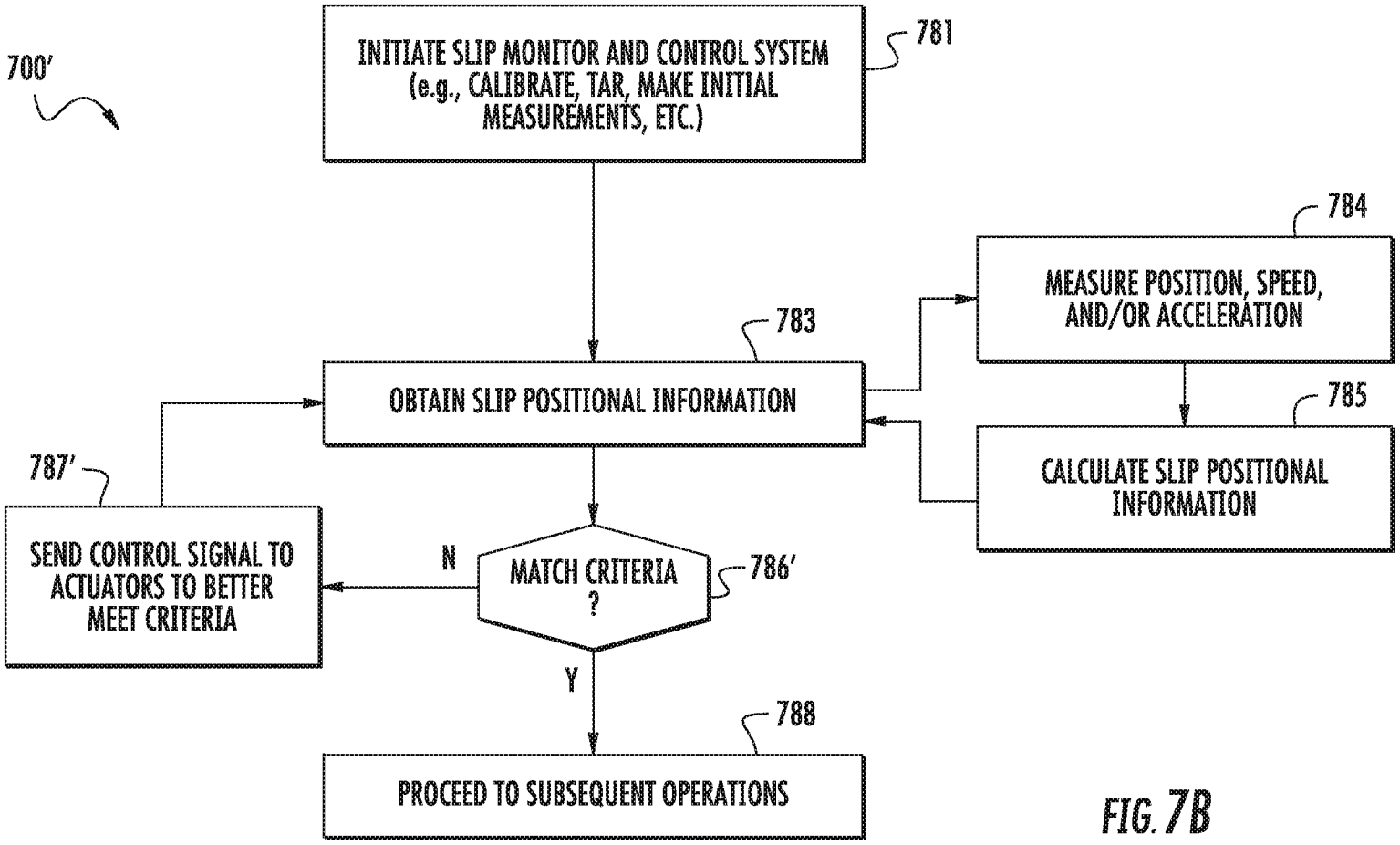

FIG. 7B illustrates an alternative method 700' of slip monitor and control. In this method 700', rather than a master-match system, the position and/or movement of the plurality of slips is coordinated based on a pre-established set of criteria. For example, the desired position and/or speed of each individual slip may be pre-set. It may be desired that each of the positions match the pre-established criteria positions to within 0.25 inch or less. In some embodiments, it may be desired that each of the positions match the pre-established criteria positions to within 0.125 inch or less. It may be desired that each of the speeds match the pre-established criteria speeds to within 10 cm/s or less. In some embodiments, it may be desired that each of the speeds match the pre-established criteria speeds to within 5 cm/s or less. Method 700' includes many of the same steps as method 700, but there is no need to identify a master slip (step 782 in FIG. 7A). Rather than determining whether the slip positional information of the non-master slips matches that of the master slip (step 786 in FIG. 7A), the slip positional information of each slip is compared to the pre-established set of criteria at step 786'. If the slip positional information fails to match, the slip monitor and control system sends control signals to actuators for one or more slips at step 787'. Once the slip positional information matches the pre-established criteria, the slip monitor and control system passes control to other systems at step 788 for subsequent operations.

In an embodiment, a slip monitor and control system includes a body; a plurality of slips; a transmitter for each slip; at least one receiver coupled to the body; and an actuator for each slip configured to move the respective slip vertically relative to the body.

In one or more embodiments disclosed herein, the actuators comprise pistons.

In one or more embodiments disclosed herein, the system also includes a proportional control valve for each piston.

In one or more embodiments disclosed herein, the system also includes a hydraulic control reservoir coupled to the pistons with hydraulic control lines.

In one or more embodiments disclosed herein, the body comprises two pivotally coupled sections.

In one or more embodiments disclosed herein, the system also includes, for each slip, at least one of a position sensor, a motion sensor, and an acceleration sensor.

In one or more embodiments disclosed herein, the system also includes, for at least one slip, a relative position sensor configured to measure a vertical distance between the transmitter for that slip and the at least one receiver.

In one or more embodiments disclosed herein, the at least one receiver is coupled to the body in a machined pocket.

In one or more embodiments disclosed herein, the at least one receiver is coupled to the body with an external mounting.

In one or more embodiments disclosed herein, the system also includes a control module.

In one or more embodiments disclosed herein, the at least one receiver is configured to provide input to the control module, and the control module is configured to send control signals to the actuators.

In an embodiment, a method of slip monitor and control includes obtaining slip positional information for a plurality of slips; determining whether the slip positional information for each of the slips matches criteria; and sending one or more control signals to one or more actuators, each actuator configured to move one of the slips vertically relative to a body.

In one or more embodiments disclosed herein, the slip positional information for each slip includes at least one of position data, speed data, and acceleration data.

In one or more embodiments disclosed herein, the slip positional information and the criteria includes position data, and the determining comprises determining whether the slip positional information for each slip matches the criteria to within 0.25 inch.

In one or more embodiments disclosed herein, the slip positional information and the criteria includes speed data, and the determining comprises determining whether the slip positional information for each slip matches the criteria to within 10 cm/s.

In one or more embodiments disclosed herein, the criteria includes a pre-established set of criteria.

In one or more embodiments disclosed herein, the method also includes identifying a master slip and one or more non-master slips from the plurality of slips, wherein the criteria for each of the non-master slips includes slip positional information of the master slip.

In one or more embodiments disclosed herein, the control signals come from a hydraulic control reservoir; and the master slip is closer to the hydraulic control reservoir than any of the non-master slips.

In one or more embodiments disclosed herein, the method also includes sending data from a transmitter on at least one of the plurality of slips to a control module, wherein the control module sends the one or more control signals.

In one or more embodiments disclosed herein, the method also includes sending data from a transmitter on at least one of the plurality of slips to a receiver on the body; and sending data from the receiver to a control module, wherein the control module sends the one or more control signals.

In one or more embodiments disclosed herein, the method also includes sending data from a sensor on at least one of the plurality of slips to a transmitter on that slip; sending data from the transmitter to a receiver on the body; and sending data from the receiver to a control module, wherein the control module sends the one or more control signals.

In one or more embodiments disclosed herein, the one or more control signals include at least one of a simple amplitude signal, a digital pulse, and a digital code.

In an embodiment, a method of handling a tubular includes actuating a plurality of slips to move vertically relative to a body; engaging the tubular with at least one of the slips; measuring positional data of the plurality of slips; and identifying an offset pipe condition.

The method of claim 23, wherein the offset pipe condition comprises the tubular in an off-center position or a tilted position relative to the body.

In one or more embodiments disclosed herein, the method also includes sending one or more control signals to change how one or more slips move relative to the body.

In one or more embodiments disclosed herein, the method also includes repeating the measuring the positional data and the sending one or more control signals until the offset pipe condition is no longer identified.

In one or more embodiments disclosed herein, the method also includes identifying a master slip and one or more non-master slips from the plurality of slips, wherein: the control signals come from a hydraulic control reservoir; and the master slip is closer to the hydraulic control reservoir than any of the non-master slips.

While the foregoing is directed to embodiments of the present invention, other and further embodiments of the invention may be devised without departing from the basic scope thereof, and the scope thereof is determined by the claims that follow.

The invention claimed is:

1. A slip monitor and control system comprising:

a body;

a plurality of slips, each slip including a gripping surface configured to engage a tubular;

at least one receiver mounted to the body; an actuator for each slip configured to move the respective slip vertically relative to the body; and wherein at east one slip of the plurality of slips includes:

a transmitter in communication with the at east one receiver;

a position sensor configured to measure a vertical distance between the transmitter for that slip and the at east one receiver and to send the measurement to the transmitter; and wherein movement of the at least one slip moves the position sensor and the transmitter relative to the at least one receiver.

2. The system of claim 1, further comprising a proportional control valve for each actuator.

3. The system of claim 1, wherein each slip further including at least one of a motion sensor or an acceleration sensor.

4. The system of claim 1, further comprising a control module.

5. The system of claim 4, wherein the at least one receiver is configured to provide input to the control module, and the control module is configured to send control signals to the actuators.

6. The system of claim 1, wherein the at least one receiver is configured to determine a first slip positional information and a second slip positional information from at least one of position data, speed data, or acceleration data.

7. The system of claim 1, wherein the number of receivers corresponds to the number of transmitters.

8. The system of claim 1, wherein the actuator is configured to move the respective slip vertically relative to the body in response to a hydraulic fluid.

9. A method of slip monitor and control, comprising:

obtaining a first slip positional information for a first slip of a plurality of slips coupled to a body by measuring a vertical distance between a relative position sensor mounted to the first slip and at least one receiver mounted to the body;

obtaining a second slip positional information for a second slip of the plurality of slips;

sending the first slip positional information from the relative position sensor to a transmitter on the first slip;

sending the first slip positional information from the transmitter to the at least one receiver on the body;

sending the first slip positional information from the receiver to a control module;

determining whether the first slip positional information and the second slip positional information match a criteria; and sending one or more control signals from the control module to one or more actuators, each actuator configured to independently move a respective slip of the first and second slips vertically relative to the body.

10. The method of claim 9, wherein the second slip positional information includes at least one data selected from a group of position data, speed data, and acceleration data, and wherein the first slip position information further includes at least one data selected from a group consisting of speed data and acceleration data.

11. The method of claim 9, wherein the first slip positional information, the second slip positional information, and the criteria include position data, and the determining comprises determining whether the first and second slip positional information for each slip matches the criteria to within 0.25 inch.

12. The method of claim 9, wherein the first slip positional information, the second slip positional information, and the criteria include speed data, and the determining comprises determining whether the first and second slip positional information for each slip matches the criteria to within 10 cm/s.

13. The method of claim 9, wherein the criteria includes a set of criteria for each slip, each set of criteria including at least one selected from a group consisting of a desired position and a desired speed.

14. The method of claim 9, further comprising identifying a master slip and one or more non-master slips from the plurality of slips, wherein the criteria for each of the non-master slips includes a slip positional information of the master slip.

15. The method of claim 14, wherein:

the control signals come from a hydraulic control reservoir; and the master slip is closer to the hydraulic control reservoir than any of the non-master slips.

16. The method of claim 9, wherein the one or more control signals include at least one selected from a group consisting of a simple amplitude signal, a digital pulse, and a digital code.

17. The method of claim 9, wherein the transmitter is configured to send the first slip positional information to the at least one receiver through one or more communication channels, wherein the one or more communication channels includes at least one selected from a group consisting of electrical wires, optical fibers, and wireless signals.

18. The method of claim 9, wherein determining comprises determining whether a first slip positional information matches a second slip positional information.

19. The method of claim 9, further comprising the receiver on the body sending the first slip positional information to the control module, wherein the control module is configured to send a first signal to the actuator for the first slip to move the first slip vertically relative to the body if the first slip positional information does not match the criteria, and wherein the control module is configured to send a second signal to the actuator for the second slip to move the second slip vertically relative to the body if the second slip positional information does not match the criteria.

20. A slip monitor and control system comprising:

a body;

a plurality of slips, each slip including a gripping surface configured to engage a tubular;

at least one receiver mounted to the body;

an actuator for each slip configured to move the respective slip vertically relative to the body; and at least one slip including:

a sensor configured to obtain data about the at least one slip including the sensor, wherein the sensor is selected from a group consisting of a motion sensor and an acceleration sensor; and a transmitter configured to send the data to the at least one receiver;

wherein:

the sensor is configured to send the data to the transmitter, and the movement of the at least one slip moves the sensor and the transmitter relative to the at least one receiver.

21. The system of claim 20, wherein the actuator is configured to move the respective slip vertically relative to the body in response to a hydraulic fluid.

22. A method of slip monitor and control, comprising:

obtaining a first slip positional information for a first slip of a plurality of slips coupled to a body by measuring a vertical distance between a relative position sensor mounted to a slip and at least one receiver mounted to the body;

obtaining a second slip positional information for a second slip of the plurality of slips;

sending data from the relative position sensor and/or a second sensor on at least one of the plurality of slips to a transmitter on that slip;

sending data from the transmitter to the receiver on the body;

sending data from the receiver to a control module;

determining whether the first slip positional information and the second slip positional information match a criteria; and sending one or more control signals from the control module to one or more actuators, each actuator configured to independently move a respective slip of the first and second slips vertically relative to the body.

* * * * *